US008368292B2

(12) United States Patent
Hsu

(10) Patent No.: US 8,368,292 B2
(45) Date of Patent: Feb. 5, 2013

(54) GLARE-FREE LED LAMP MODULE

(76) Inventor: Tien-Ting Hsu, Gongguan (CN)

( * ) Notice: Subject to any disclaimer, the term of this patent is extended or adjusted under 35 U.S.C. 154(b) by 0 days.

(21) Appl. No.: 13/212,936

(22) Filed: Aug. 18, 2011

(65) Prior Publication Data

US 2012/0313498 A1 Dec. 13, 2012

(30) Foreign Application Priority Data

Jun. 7, 2011 (CN) ..... 2011 2 0187190 U

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |

(52) U.S. Cl. ..... 313/46; 362/294

(58) Field of Classification Search ..... 318/218, 318/294, 373; 313/46; 362/218, 294, 373, 362/311.02

See application file for complete search history.

(56) References Cited

U.S. PATENT DOCUMENTS

| | | | | |
|---|---|---|---|---|
| 2005/0111222 | A1* | 5/2005 | Olsson et al. | 362/267 |
| 2006/0291197 | A1* | 12/2006 | Patti | 362/153.1 |
| 2009/0097266 | A1* | 4/2009 | Lin | 362/487 |
| 2009/0116251 | A1* | 5/2009 | Harbers et al. | 362/373 |
| 2009/0128737 | A1* | 5/2009 | Ouderkirk et al. | 349/64 |
| 2010/0032182 | A1* | 2/2010 | Arbel | 174/66 |
| 2010/0289407 | A1* | 11/2010 | Anderson et al. | 315/35 |
| 2011/0157896 | A1* | 6/2011 | Yu | 362/293 |
| 2011/0205742 | A1* | 8/2011 | Lee | 362/294 |
| 2012/0019144 | A1* | 1/2012 | Lai | 315/112 |

* cited by examiner

*Primary Examiner* — Mariceli Santiago
*Assistant Examiner* — Glenn Zimmerman

(57) ABSTRACT

A glare-free light emitting diode (LED) lamp module includes a heat sink, an LED light source and an LED cover. Multiple rows of threads are integrally formed on a circumferential outer surface of the heat sink for the purposes of mounting and heat dissipation. In one embodiment, a mounting portion is provided on and integrally formed with the heat sink. The LED light source is mounted on the mounting portion. The LED cover is attached to the mounting portion. In another embodiment, a mounting hole is defined through the heat sink for receiving and mounting an LED lamp core and an LED lamp socket therein. The LED cover is attached to the LED lamp core. The LED lamp module can be used to replace the bulb of an incandescent lamp, while the other parts of the incandescent lamp can be retained for continuing use.

7 Claims, 7 Drawing Sheets

GLARE-FREE LED LAMP MODULE

TECHNICAL FIELD

The present invention relates to an illumination lamp, and more particularly to a glare-free light emitting diode (LED) lamp module.

BACKGROUND

Incandescent lamps are commonly used for illumination purpose. However, conventional incandescent lamps consume a lot of electric energy and have a short service life. Once an incandescent lamp is broken, the incandescent lamp is wholly scrapped and thereafter a new incandescent lamp must be purchased to replace the original one, thereby bringing great economic losses for the user.

With the continuous development of society and progress of science and technology, the incandescent lamps due to great power consumption and short service life are gradually replaced by light emitting diode (LED) lamps. However, prior art LED lamps generally generate glare which is irritating and harmful to the eyes of user. Furthermore, in the replacement of the incandescent lamp, it is desired to replace only the bulb of the incandescent lamp, while most other parts of the incandescent lamp can be retained for continuing use to thereby reduce the costs. Therefore, in order to save energy resources and reduce economic costs, a glare-free LED lamp module is urgently expected to come out, whereby the glare-free LED lamp module can be used to replace the bulb of the incandescent lamp, with the other parts of the incandescent lamp being retained for continuing use to promote the whole luminous uniformity and brightness of the lamp while eliminating glare on the eyes of user.

SUMMARY

The present invention provides a glare-free LED lamp module for replacing a bulb of an incandescent lamp.

In one embodiment, the glare-free LED lamp module includes a heat sink, an LED light source and an LED cover. The heat sink is provided with multiple rows of threads on a circumferential outer surface thereof for the purposes of mounting and heat dissipation. The multiple rows of threads are integrally formed together with the heat sink. A mounting portion is provided on and integrally formed together with the heat sink. The LED light source is mounted on the mounting portion. The LED cover is attached to the mounting portion.

In another embodiment, the glare-free LED lamp module includes a heat sink, an LED lamp core, an LED lamp socket, an LED light source and an LED cover. The heat sink is provided with multiple rows of threads on a circumferential outer surface thereof for the purposes of mounting and heat dissipation. The multiple rows of threads are integrally formed together with the heat sink. A mounting hole is defined through the heat sink. The LED lamp core and the LED lamp socket are received and mounted in the mounting hole. The LED light source is mounted on the LED lamp core. The LED cover is attached to the LED lamp core.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
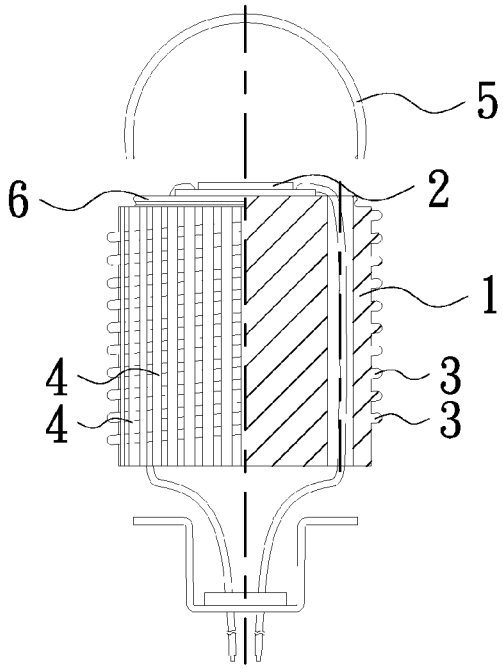
FIG. 1 is a partially cross-sectional view schematically illustrating a glare-free LED lamp module before assembly according to a first embodiment of the present invention.
Figure 2:
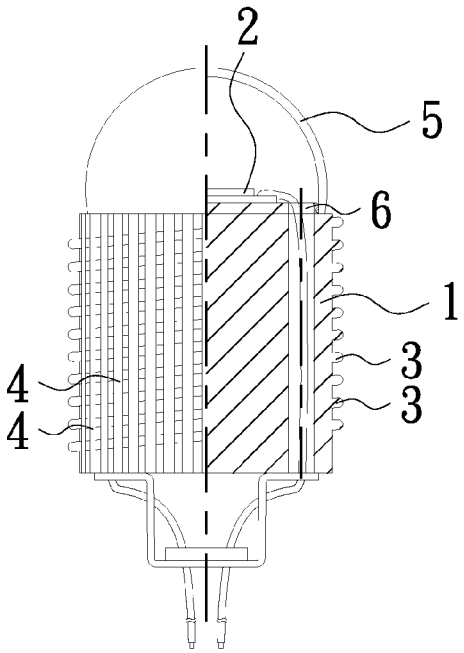
FIG. 2 shows the glare-free LED lamp module of FIG. 1 after assembly.

FIGS. 1 and 2 schematically show a glare-free LED lamp module according to a first embodiment of the present invention. Referring to FIGS. 1 and 2, the glare-free LED lamp module includes a column-shaped heat sink 1 and an LED light source 2 mounted on the heat sink 1. Multiple rows of threads 3 are formed on a circumferential outer surface of the heat sink 1 for the purposes of mounting and heat dissipation. The multiple rows of threads 3 are integrally formed together with the heat sink 1. The glare-free LED lamp module further includes an LED cover 5 and a mounting portion 6. The mounting portion 6 is formed on one end of the heat sink 1. Specifically, the mounting portion 6 is integrally formed together with the heat sink 1 and protrudes upwards from the heat sink 1. The LED light source 2 is mounted on the mounting portion 6, and the LED cover 5 is securely attached to the mounting portion 6. A radially outer surface of the mounting portion 6 is provided with mounting teeth, and the LED cover 5 is engaged with the mounting teeth of the mounting portion 6 to thereby securely attach the LED cover 5 to the mounting portion 6. The LED cover 5 is formed by diffusion powder layers alternated with PMMA (Polymethylmethacrylate) layers. A plurality of grooves 4 are longitudinally defined in the circumferential outer surface of the heat sink 1 to cut through the threads 3. The grooves 4 and the threads 3 are corresponded to each other on the heat sink 1. Each row of thread 3 is spaced from a neighboring row of thread 3. The heat sink 1 and the threads 3 are made from a material having an excellent heat dissipation property, such as aluminum alloy, magnesium alloy, copper alloy, or dielectric but thermally conductive plastic material. An electric wire is provided, with one end of the electric wire being electrically connected with the LED light source 2. In the replacement of an incandescent lamp, the glare-free LED lamp module can be used to replace the bulb of the incandescent lamp, while the other parts of the incandescent lamp can be retained for continuing use. For example, the retained outer ring of the incandescent lamp can be screwed together with the threads 3 of the heat sink 1 so as to mount the glare-free LED lamp module to the retained outer ring of the incandescent lamp. Thus, the glare-free LED lamp module together with the retained parts of the incandescent lamp cooperatively form an LED lamp. Since the LED cover 5 is formed by diffusion powder layers alternated with PMMA layers, the whole luminous uniformity and brightness of the LED lamp is greatly improved, thereby eliminating glare which is irritating and harmful to the eyes of user. The glare-free LED lamp module has a simple structure and can be used to replace the bulb of the incandescent lamp conveniently. Thus, the glare-free LED lamp module can be easily and commonly accepted by users for the purpose of saving energy.

Figure 3:
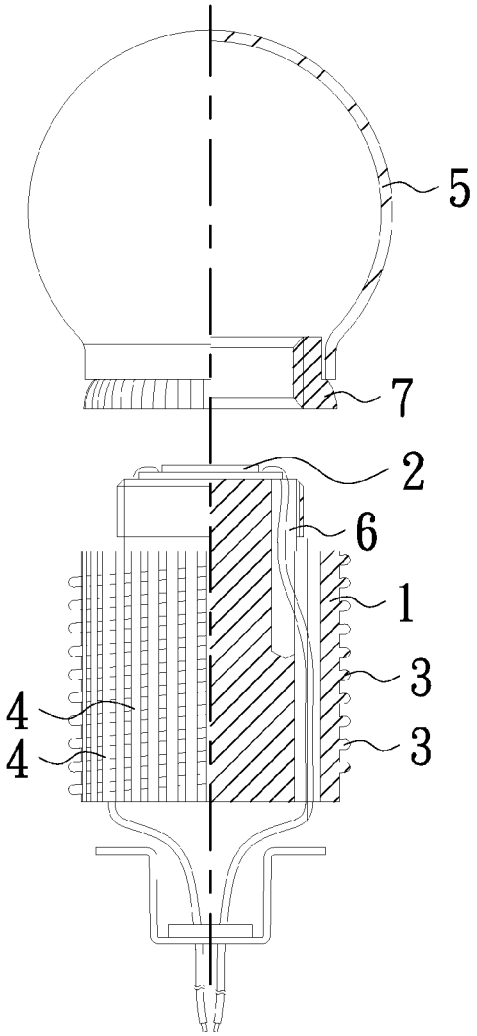
FIG. 3 is a partially cross-sectional view schematically illustrating a glare-free LED lamp module before assembly according to a second embodiment of the present invention.
Figure 4:
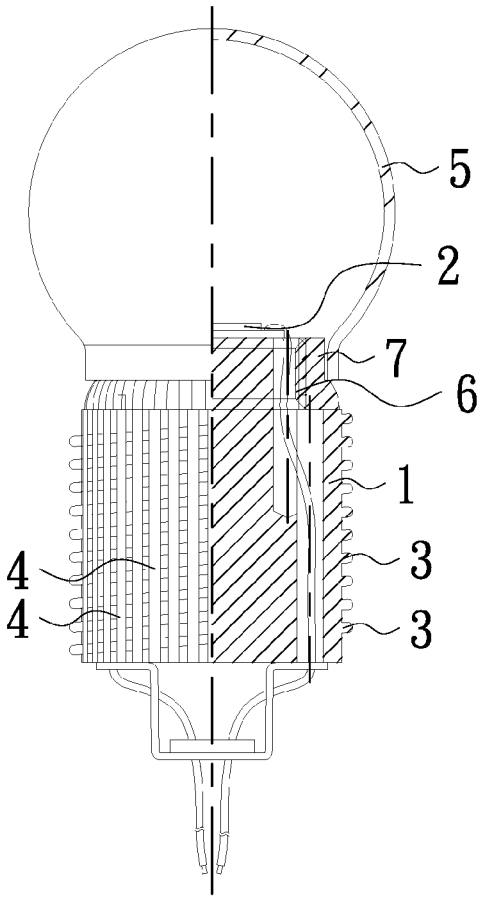
FIG. 4 shows the glare-free LED lamp module of FIG. 3 after assembly.

FIGS. 3 and 4 schematically show a glare-free LED lamp module according to a second embodiment of the present invention. Referring to FIGS. 3 and 4, the glare-free LED lamp module includes a column-shaped heat sink 1 and an LED light source 2 mounted on the heat sink 1. Multiple rows of threads 3 are formed on a circumferential outer surface of the heat sink 1 for the purposes of mounting and heat dissipation. The multiple rows of threads 3 are integrally formed together with the heat sink 1. The glare-free LED lamp module further includes an LED cover 5 and a mounting portion 6. The mounting portion 6 is formed on one end of the heat sink 1. Specifically, the mounting portion 6 is integrally formed together with the heat sink 1 and protrudes upwards from the heat sink 1. The LED light source 2 is mounted on the mounting portion 6, and the LED cover 5 is securely attached to the mounting portion 6. The glare-free LED lamp module further includes a mounting ring 7. An inner surface of the mounting ring 7 is provided with an inner thread. A radially outer surface of the mounting portion 6 is provided with an outer thread. The mounting ring 7 is glued to the LED cover 5, and the inner thread of the mounting ring 7 is threadedly engaged with the outer thread of the mounting portion 6 to thereby attach the LED cover 5 to the mounting portion 6. The presence of the mounting ring 7 can prevent the LED light source 2 from being burned out due to overheating in the assembly process of the components. A diffusion powder layer is coated on an inner surface of the LED cover 5. A plurality of grooves 4 are longitudinally defined in the circumferential outer surface of the heat sink 1 to cut through the threads 3. The grooves 4 and threads 3 are corresponded to each other on the heat sink 1. Each row of thread 3 is spaced from a neighboring row of thread 3. The heat sink 1 and the threads 3 are made from a material having an excellent heat dissipation property, such as aluminum alloy, magnesium alloy, copper alloy, or dielectric but thermally conductive plastic material. An electric wire is provided, with one end of the electric wire being electrically connected with the LED light source 2. In the replacement of an incandescent lamp, the glare-free LED lamp module can be used to replace the bulb of the incandescent lamp, while the other parts of the incandescent lamp can be retained for continuing use. For example, the retained outer ring of the incandescent lamp can be screwed together with the threads 3 of the heat sink 1 so as to mount the glare-free LED lamp module to the retained outer ring of the incandescent lamp. Thus, the glare-free LED lamp module together with the retained other parts of the incandescent lamp cooperatively form an LED lamp. Since the inner surface of the LED cover 5 is provided with the diffusion powder layer, the whole luminous uniformity and brightness of the LED lamp is greatly improved, thereby eliminating glare which is irritating and harmful to the eyes of user. The glare-free LED lamp module has a simple structure and can be used to replace the bulb of the incandescent lamp conveniently. Thus, the glare-free LED lamp module can be easily and commonly accepted by users for the purpose of saving energy.

Figure 5:
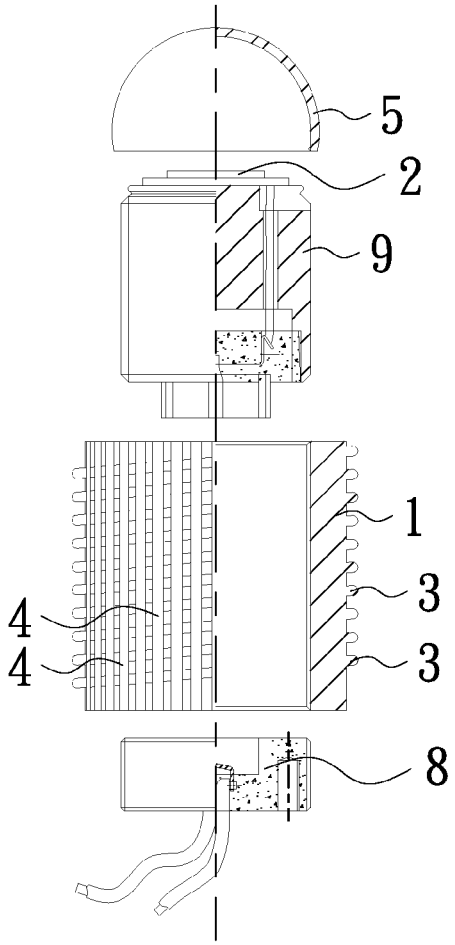
FIG. 5 is a partially cross-sectional view schematically illustrating a glare-free LED lamp module before assembly according to a third embodiment of the present invention.
Figure 6:
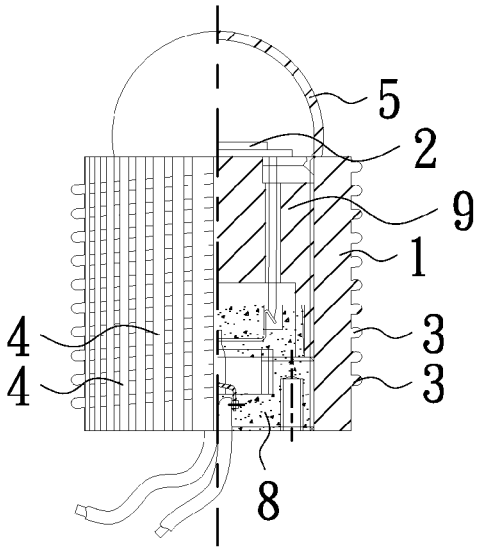
FIG. 6 shows the glare-free LED lamp module of FIG. 5 after assembly.

FIGS. 5 and 6 schematically show a glare-free LED lamp module according to a third embodiment of the present invention. Referring to FIGS. 5 and 6, the glare-free LED lamp module includes a column-shaped heat sink 1, an LED light source 2, an LED lamp core 9 and an LED lamp socket 8. Multiple rows of threads 3 are formed on a circumferential outer surface of the heat sink 1 for the purposes of mounting and heat dissipation. The multiple rows of threads 3 are integrally formed together with the heat sink 1. A mounting hole is centrally defined through the heat sink 1 for receiving and mounting the LED lamp core 9 and the LED lamp socket 8 therein. The LED light source 2 is replaceably mounted on the LED lamp core 9. The glare-free LED lamp module further includes an LED cover 5 securely attached to the LED lamp core 9. Particularly, a radially outer surface of the LED lamp core 9 is provided with mounting teeth, and the LED cover 5 is engaged with the mounting teeth of the LED lamp core 9 to thereby attach the LED cover 5 to the LED lamp core 9. The LED cover 5 is formed by diffusion powder layers alternated with PMMA (Polymethylmethacrylate) layers. A plurality of grooves 4 are longitudinally defined in the circumferential outer surface of the heat sink 1 to cut through the threads 3. The grooves 4 and the threads 3 are corresponded to each other on the heat sink 1. Each row of thread 3 is spaced from a neighboring row of thread 3. The heat sink 1 and the threads 3 are made from a material having an excellent heat dissipation property, such as aluminum alloy, magnesium alloy, copper alloy, or dielectric but thermally conductive plastic material. An electric wire is provided, with one end of the electric wire being electrically connected with the LED light source 2. In the replacement of an incandescent lamp, the glare-free LED lamp module can be used to replace the bulb of the incandescent lamp, while the other parts of the incandescent lamp can be retained for continuing use. For example, the retained outer ring of the incandescent lamp can be screwed together with the threads 3 of the heat sink 1 so as to mount the glare-free LED lamp module to the retained outer ring of the incandescent lamp. Thus, the glare-free LED lamp module together with the retained other parts of the incandescent lamp cooperatively form an LED lamp. Since the LED cover 5 of the glare-free LED lamp module is formed by diffusion powder layers alternated with PMMA layers, the whole luminous uniformity and brightness of the LED lamp is greatly improved, thereby eliminating glare which is irritating and harmful to the eyes of user. The glare-free LED lamp module has a simple structure and can be used to replace the bulb of the incandescent lamp conveniently. Thus, the glare-free LED lamp module can be easily and commonly accepted by users for the purpose of saving energy.

Figure 7:
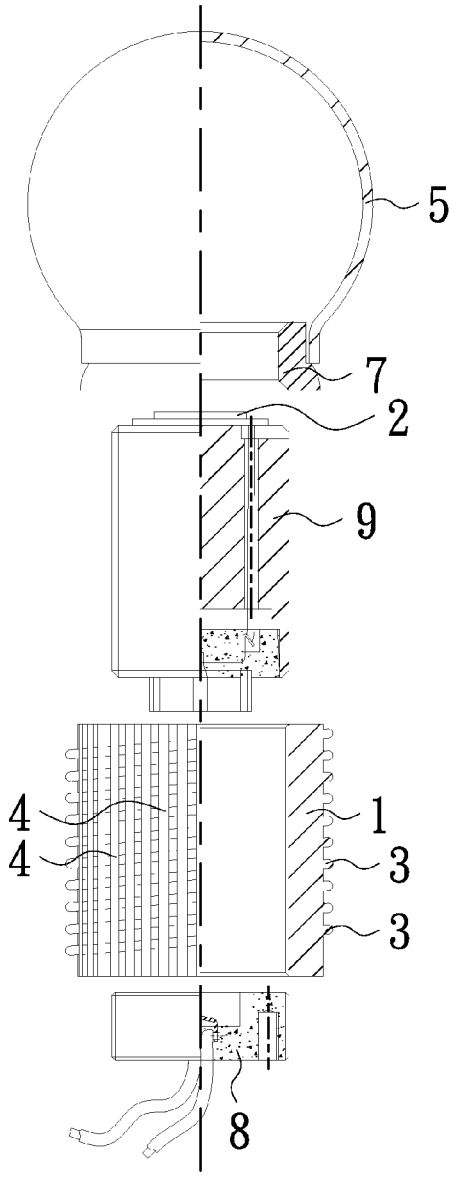
FIG. 7 is a partially cross-sectional view schematically illustrating a glare-free LED lamp module before assembly according to a fourth embodiment of the present invention.
Figure 8:
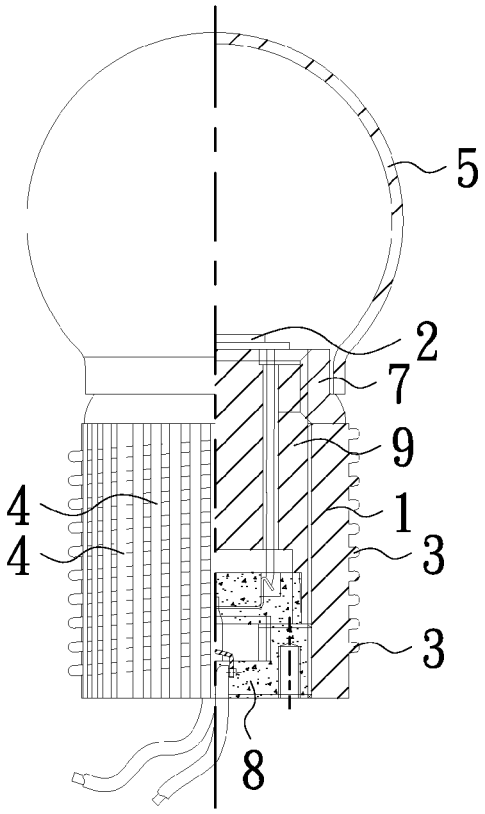
FIG. 8 shows the glare-free LED lamp module of FIG. 7 after assembly.

FIGS. 7 and 8 schematically show a glare-free LED lamp module according to a fourth embodiment of the present invention. Referring to FIGS. 7 and 8, the glare-free LED lamp module includes a column-shaped heat sink 1, an LED light source 2, an LED lamp core 9 and an LED lamp socket 8. Multiple rows of threads 3 are formed on a circumferential outer surface of the heat sink 1 for the purposes of mounting and heat dissipation. The multiple rows of threads 3 are integrally formed together with the heat sink 1. A mounting hole is centrally defined through the heat sink 1 for receiving and mounting the LED lamp core 9 and the LED lamp socket 8 therein. The LED light source 2 is replaceably mounted on the LED lamp core 9. The glare-free LED lamp module further includes an LED cover 5 and a mounting ring 7. An inner surface of the mounting ring 7 is provided with an inner thread. A radially outer surface of the LED lamp core 9 is provided with an outer thread. The mounting ring 7 is glued to the LED cover 5, and the inner thread of the mounting ring 7 is threadedly engaged with the outer thread of the LED lamp core 9 to thereby attach the LED cover 5 to the LED lamp core 9. The presence of the mounting ring 7 can prevent the LED light source 2 from being burned out due to overheating in the assembly process of the components. A diffusion powder layer is coated on an inner surface of the LED cover 5. A plurality of grooves 4 are longitudinally defined in the outer surface of the heat sink 1 to cut through the threads 3. The grooves 4 and the threads 3 are corresponded to each other on the heat sink 1. Each row of thread 3 is spaced from a neighboring row of thread 3. The heat sink 1 and the threads 3 are made from a material having an excellent heat dissipation property, such as aluminum alloy, magnesium alloy, copper alloy, or dielectric but thermally conductive plastic material. An electric wire is provided, with one end of the electric wire being electrically connected with the LED light source 2. In the replacement of an incandescent lamp, the glare-free LED lamp module can be used to replace the bulb of the incandescent lamp, while the other parts of the incandescent lamp can be retained for continuing use. For example, the retained outer ring of the incandescent lamp can be screwed together with the threads 3 of the heat sink 1 so as to mount the glare-free LED lamp module to the retained outer ring of the incandescent lamp. Thus, the glare-free LED lamp module together with the retained other parts of the incandescent lamp cooperatively form an LED lamp. Since the inner surface of the LED cover 5 is provided with the diffusion powder layer, the whole luminous uniformity and brightness of the LED lamp is greatly improved, thereby eliminating glare which is irritating and harmful to the eyes of user. The glare-free LED lamp module has a simple structure and can be used to replace the bulb of the incandescent lamp conveniently. Thus, the glare-free LED lamp module can be easily and commonly accepted by users for the purpose of saving energy.

The glare-free LED lamp modules of the above illustrated embodiments have the following advantages. The multiple rows of threads 3 provided on the heat sink 1 can greatly increase the heat-dissipating surface area for the glare-free LED lamp module. Thus, the heat generated by the glare-free LED lamp module in operation can be dissipated away rapidly and efficiently by the heat sink 1, thereby prolonging the service life for the glare-free LED lamp module. In the replacement of a conventional incandescent lamp, only the bulb of the incandescent lamp is needed to be replaced by the glare-free LED lamp module, while the other parts of the incandescent lamp can be retained for continuing use, thereby reducing economic costs and saving energy for the users. In the replacement of the incandescent lamp, LED light sources with different powers and different colors can be selected to replace the bulb of the incandescent lamp. An LED lamp with the glare-free LED lamp module can improve the grade of indoor decoration and illumination condition and prolong the service life for the LED lamp. Since the LED cover of the glare-free LED lamp module is formed by diffusion powder layers alternated with PMMA layers, or in another way, the inner surface of the LED cover 5 is provided with the diffusion powder layer, the whole luminous uniformity and brightness of the LED lamp is greatly improved, thereby eliminating glare which is irritating and harmful to the eyes of user. The presence of the mounting ring can prevent the LED light source from being burned out due to overheating in the assembly process of the components of the LED lamp. The glare-free LED lamp module has a simple structure and can be used to replace the bulb of the incandescent lamp conveniently. The glare-free LED lamp module can be easily and commonly accepted by users for the purpose of saving energy.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A glare-free light emitting diode (LED) lamp module, comprising:

a heat sink being provided with multiple rows of threads on a circumferential outer surface thereof for the purposes of mounting and heat dissipation, the multiple rows of threads being integrally formed together with the heat sink, a mounting hole being defined through the heat sink;

an LED lamp core received and mounted within the frontward end in the mounting hole;

an LED lamp socket received and mounted within the rearward end in the mounting hole;

an LED light source being mounted on the LED lamp core wherein the LED lamp core is disposed between the LED light source and the LED lamp socket; and an LED cover attached to the LED lamp core;

a mounting ring, wherein an inner surface of the mounting ring is provided with an inner thread, a radially outer surface of the LED lamp core is provided with an outer thread, the mounting ring is received in the LED cover and attached to a bottom of the LED cover, and the inner thread of the mounting ring is engaged with the outer thread of the LED lamp core;

wherein an outer surface of the LED lamp core is engaged with an inner surface of the mounting hole, and an outer surface of the LED lamp socket is engaged with the inner surface of the mounting hole.

2. The glare-free LED lamp module according to claim 1, wherein a radially outer surface of the LED lamp core is provided with mounting teeth, and the LED cover is engaged with the mounting teeth of the LED lamp core.

3. The glare-free LED lamp module according to claim 1, wherein the LED cover is formed by diffusion powder layers alternated with PMMA (Polymethylmethacrylate) layers.

4. The glare-free LED lamp module according to claim 1, wherein a diffusion powder layer is coated on an inner surface of the LED cover.

5. The glare-free LED lamp module according to claim 1, wherein a plurality of grooves are longitudinally defined in the circumferential outer surface of the heat sink to cut through the threads, the grooves and the threads are corresponded to each other on the heat sink, each row of thread is spaced from a neighboring row of thread.

6. The glare-free LED lamp module according to claim 1, wherein the heat sink and the threads are made from a material selected from the group consisting of aluminum alloy, magnesium alloy, copper alloy, and dielectric but thermally conductive plastic material.

7. The glare-free LED lamp module according to claim 1, wherein the heat sink has a column-shaped profile.

* * * * *